US005247999A

United States Patent [19]

Fowler

[11] Patent Number: 5,247,999

[45] Date of Patent: Sep. 28, 1993

[54] OIL WELLHEAD FIRE EXTINGUISHING APPARATUS HAVING ADJUSTABLE SUPPORT FEET AND LABYRINTH MODULE

[76] Inventor: John T. Fowler, R.F.D. #2, Box 5730, Winthrop, Me. 04364

[21] Appl. No.: 765,325

[22] Filed: Sep. 25, 1991

[51] Int. Cl.[5] ..... A62C 3/00

[52] U.S. Cl. ..... 169/52; 169/69

[58] Field of Search ..... 169/69, 43, 47, 49, 169/52

[56] References Cited

U.S. PATENT DOCUMENTS

| | | | |
|---|---|---|---|
| 1,807,498 | 5/1931 | Teed | 169/69 X |
| 1,830,061 | 11/1931 | Howe | 169/69 X |
| 4,323,118 | 4/1982 | Bergmann | 169/69 X |
| 5,131,444 | 7/1992 | Hunter, III | 169/69 X |
| 5,191,940 | 3/1993 | Alonso et al. | 169/69 |

*Primary Examiner*—David M. Mitchell
*Assistant Examiner*—Andrew C. Pike
*Attorney, Agent, or Firm*—H. Jay Spiegel

[57] ABSTRACT

The present invention is designed to be mounted over a flaming oil wellhead to extinguish the flames. The invention includes a base having hydraulically operable arms designed to allow secure support of the base over the oil wellhead even in uneven terrain. A cap device is mountable on the base and includes tangentially arranged ports designed to supply the interior of the cap with a fluid such as liquid nitrogen to cool and extinguish the flames. The cap may include a labyrinth tortuous path restrictor forcing escaping combustion products and other gases to follow a tortuous path to atmosphere to thereby cause the gases to lose energy and cool as they escape.

4 Claims, 3 Drawing Sheets

OIL WELLHEAD FIRE EXTINGUISHING APPARATUS HAVING ADJUSTABLE SUPPORT FEET AND LABYRINTH MODULE

BACKGROUND OF THE INVENTION

The present invention relates to an oil wellhead fire extinguishing apparatus. In the prior art, fire extinguishing devices are known, however, the invention is unaware of any such device including all of the various objects, aspects and features of the present invention. The following prior art is known to the inventor:

U.S. Pat. No. 3,905,424 to Elwood et al. discloses a device including a jacket surrounding a pipe of flowing fluid with the jacket being designed to receive a cryogenic fluid to freeze and slow the movement of fluid in the surrounded conduit. The present invention differs from the teachings of this patent as contemplating direct exposure of a cryogenic fluid to a flaming oil well head to starve it of oxygen and put out flames.

U.S. Pat. No. 4,323,118 to Bergmann discloses an apparatus for controlling and preventing oil blowouts which includes a dome which may be mounted over an exposed oil well head and having valves designed to control and divert fluid flowing out of the head. The present invention differs from the teachings of Bergmann as contemplating supplying a cap with a cryogenic fluid to starve a flaming oil wellhead of oxygen and put out the flames.

U.S. Pat. No. 4,433,733 to Cunningham discloses an oil storage tank extinguisher which includes a cap device designed to be lowered over a flaming oil well or oil tank. Cunningham contemplates injecting a fire retardant fluid such as water therein. The present invention differs from the teachings of Cunningham as contemplating a cap having tangentially arranged ports designed to inject a cryogenic fluid directly over an oil wellhead to starve the fire of oxygen and put out the fire. The present invention also differs from Cunningham as contemplating sophisticated base structure allowing support of the device in uneven terrain.

U.S. Pat. No. 4,899,827 to Poole discloses an oil well fire control system which contemplates injection of pressurized carbon dioxide, nitrogen, monoammonia phosphate or other materials into the flow of hydrocarbons to stop a fire. The present invention differs from the teachings of Poole as contemplating a sophisticated base structure as well as tangentially arranged cryogenic fluid ports.

SUMMARY OF THE INVENTION

The present invention relates to an oil wellhead fire extinguishing apparatus. The present invention includes the following interrelated objects, aspects and features:

(a) In a first aspect, the inventive fire extinguishing apparatus includes a base made of an inner shell made up of a refractory material surrounded by an outer steel casing.

(b) The base includes a structure allowing it to be securely mounted over an oil wellhead even in uneven terrain. This structure includes a plurality of circumferentially disposed support arms having hydraulic means allowing positional adjustment of support pedestals which include structure allowing them to be embedded in the ground.

(c) A cap is sized and configured to be mountable over the base in surrounding relation to the terminus of the oil wellhead. The cap is preferably made of a refractory material and includes a plurality of circumferentially disposed tangential inlet ports which are connected to a manifold supplied with a source of cryogenic fluid such as, for example, liquid nitrogen.

(d) The cap includes an upper outlet port which includes a labyrinth module providing a tortuous path restrictor causing combustion gases and other fluids to leave the cap by following a tortuous path and thereby to lose energy while travelling this flow path.

As such, it is a first object of the present invention to provide an oil wellhead fire extinguishing apparatus.

It is a further object of the present invention to provide such a device having a base designed to be supportable even on uneven terrain.

It is a still further object of the present invention to provide such a device having a refractory cap with a tortuous path restrictor contained therein as well as ports allowing tangential flow of a cryogenic fluid.

It is a still further object of the present invention to provide such a device which may be used to put out an oil wellhead fire.

These and other objects, aspects and features of the present invention will be better understood from the following detailed description of the preferred embodiment when read in conjunction with the appended drawing figures.

DETAILED DESCRIPTION OF THE PREFERRED EMBODIMENT

Figure 1:
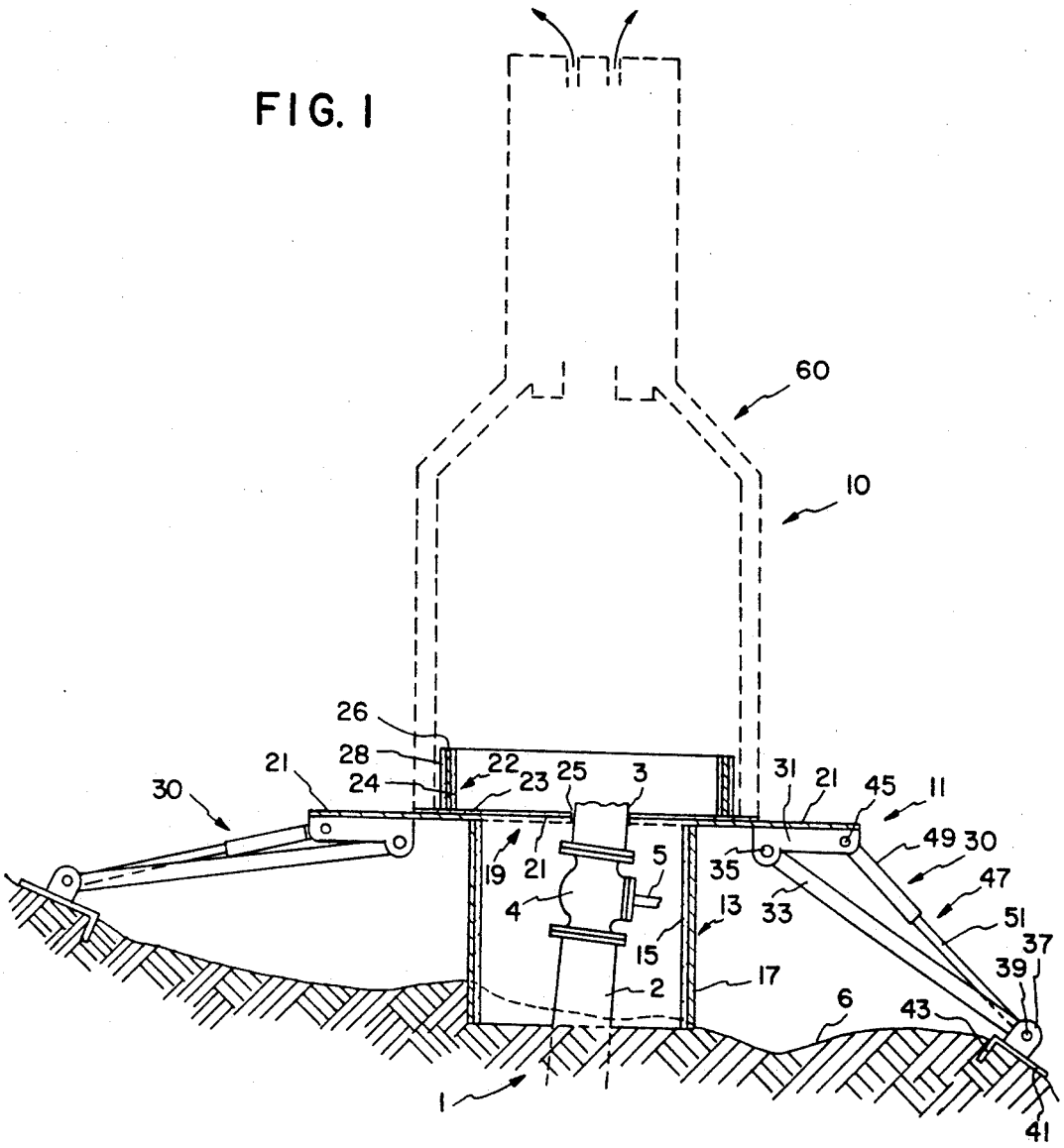
FIG. 1 shows a side view of the present invention with portions in cross-section to show detail and with the cap portion thereof shown in phantom.

With reference, first, to FIG. 1, an oil wellhead is generally designated by the reference numeral 1 and is seen to include a conduit 2 having a terminus 3 as well as a valve 4 between the conduit 2 and the terminus 3 and having an actuator stem 5. The conduit 2 protrudes from the terrain 6 which, as shown in FIG. 1, may be uneven.

Figure 2:
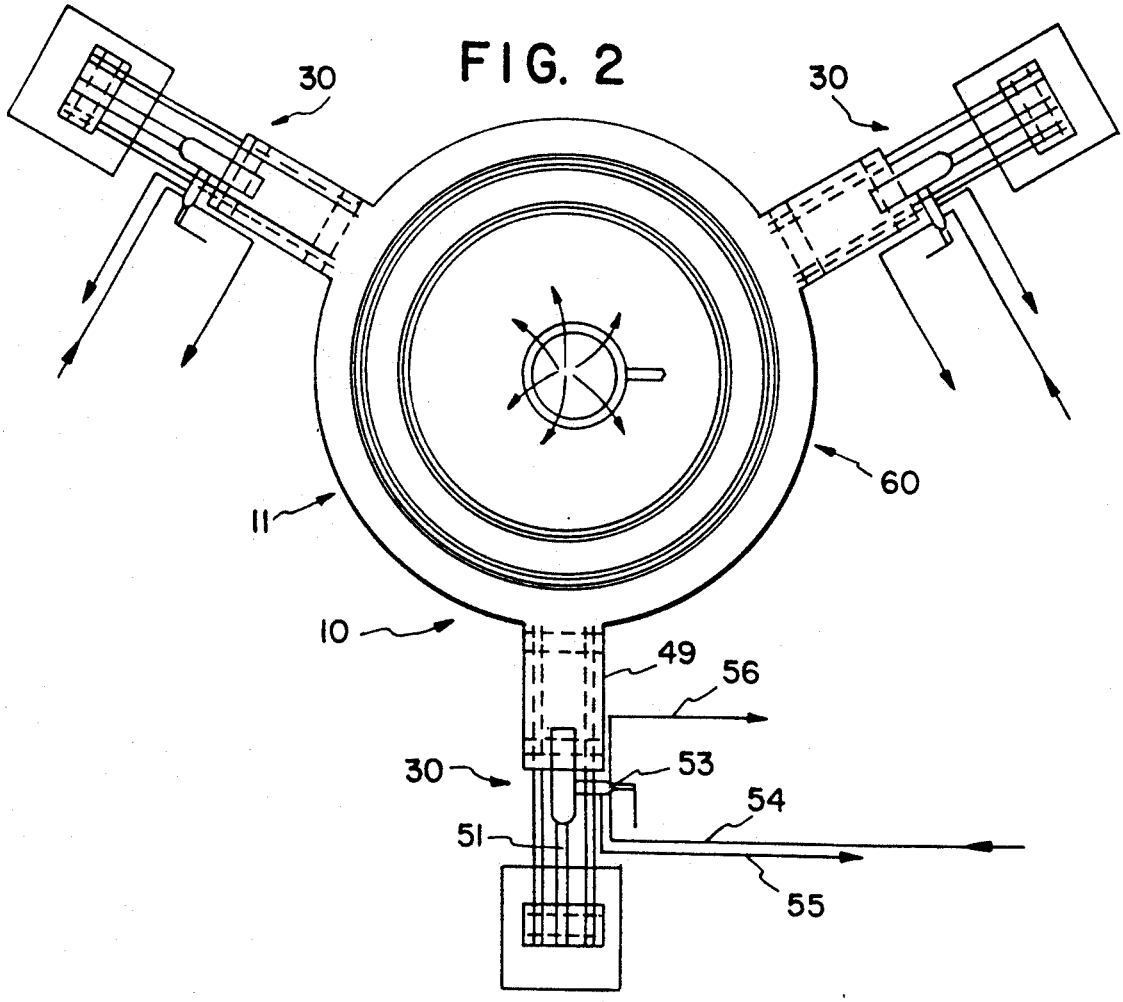
FIG. 2 shows a top view of the present invention.

With reference to FIGS. 1 and 2, the present invention is generally designated by the reference numeral 10 and is seen to include a base 11 and a cap 60 which is shown in phantom in FIGS. 1 and 2.

With further reference to FIGS. 1 and 2, the base 11 is seen to include a lower chamber 13 having inner walls 15 made of a refractory material such as, for example, ceramic and an outer casing 17 made of a material such as, for example, steel. The lower chamber 13 is sized and configured to laterally surround the conduit 2 and terminus 3.

As further shown in FIG. 1, the chamber 13 has an upper wall 19 including an inner portion 21 made of a steel material and an outer portion 23 made of refractory material. The wall 19 includes an opening 25 designed to allow the terminus 3 to protrude partially therethrough. As shown in FIG. 1, the portion 21 extends radially outwardly beyond the walls of the chamber 13 and has mounted thereon support feet 30. The support feet 30 are identical to one another and, as such, one of these feet will be described in greater detail with reference to FIGS. 1 and 2.

As shown in FIG. 1, a typical foot 30 has a mounting bracket 31 which may be attached to the portion 21 in any suitable manner such as, for example, by bolting or welding. The bracket 31 has, pivotably mounted thereto, a leg 33 mounted to the bracket 31 by a pivot pin 35. The leg 33 extends outwardly away from the bracket 31 and terminates at a pivot 37 including a pivot pin 39, with the pivot 37 having a foot 41 attached thereto with a claw member 43 designed to embed in the ground 6.

The bracket 31 also has a pivot 45 to which is mounted a working member 47 consisting of a cylinder 49 containing a piston (not shown) which has attached thereto a piston rod 51. The piston rod 51 is also pivotably attached at the pivot 39.

With reference to FIG. 2, it is seen that a control valve 53 controls flow of hydraulic fluid to and from the cylinder 49 to control extension and contraction movements of the piston rod 51 with respect thereto. The control valve 53 is not shown in great detail but may be any suitable supply and exhaust valve such as a four port reversing valve which may be used to supply fluid on one side of the piston (not shown) while fluid on the other side of the piston is exhausted from the cylinder and flows to a sump. Such a valve may be reversed to cause pressure to be applied on the other side of the piston to cause reverse movements of the piston rod 51. As should be understood from FIG. 1, extensions and retractions of the piston rod 51 with respect to the cylinder 49 will result in pivoting movements of the leg 33 and thereby adjustment of the horizontal and vertical position of the foot 41. In this regard, with further reference to FIG. 2, it is seen that the valve 53 is provided with a supply line 54 as well as return lines 55 and 56. Of course, again, the details of the valve 53 are generally known to those skilled in the art and do not specifically form a part of the present invention.

With further reference to FIG. 1, it is seen that the wall 19 has mounted thereon an annular wall 22 having three layers, an inner refractory layer 24, a central steel layer 26 and an outer refractory layer 28. The outer refractory layer 28 has an outer periphery sized and configured to allow close receipt of the cap 60 as will be described in greater detail hereinafter.

Figure 3:
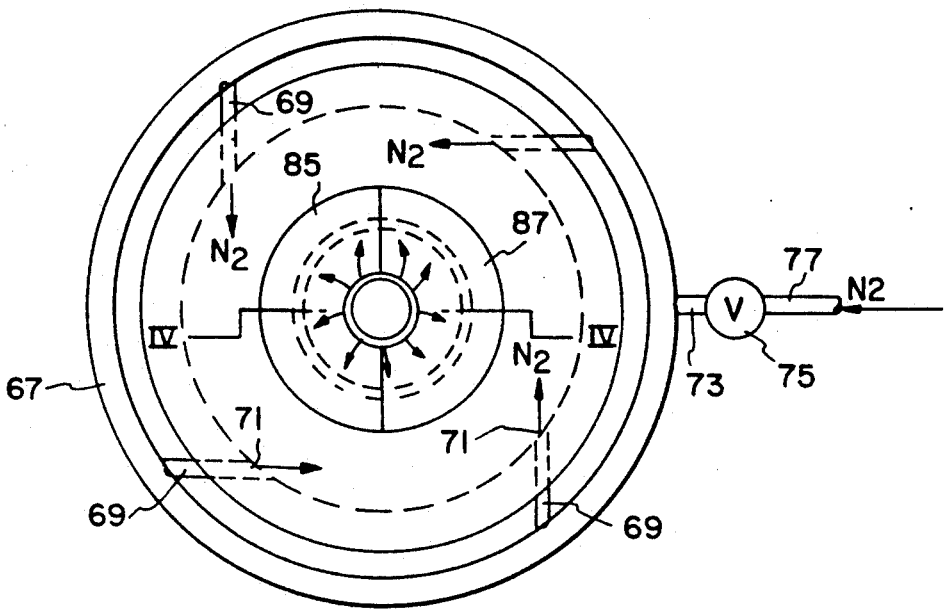
FIG. 3 shows a top view of the present invention with certain portions in cross-section and broken away to show detail.
Figure 4:
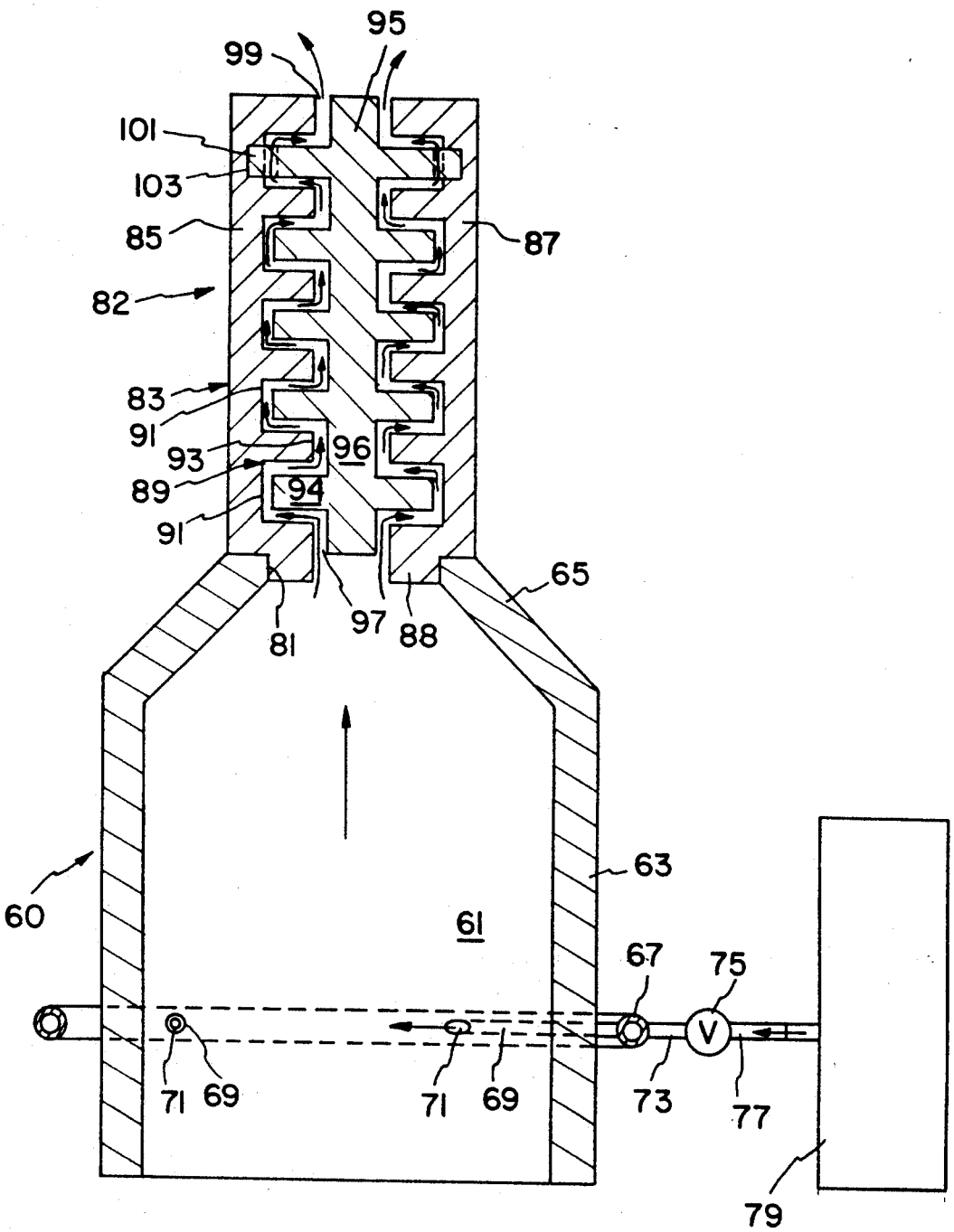
FIG. 4 shows a cross-sectional view through the cap structure of the present invention along the line IV—IV of FIG. 3.

With reference to FIGS. 3 and 4, the cap 60 is seen to include a lower chamber 61 defined by outer cylindrical walls 63 and frustro-conical walls 65 thereabove. A manifold 67 is mounted in surrounding relation to the walls 63 and has a plurality of outlet conduits 69 which emanate therefrom inwardly in a manner whereby, with particular reference to FIG. 3, each conduit 69 has a port 71 which is tangentially arranged in the chamber 61 of the cap 60. As shown in FIGS. 3 and 4, the manifold 67 is supplied with cryogenic fluid by a arranged to a source of cryogenic fluid shown in FIG. 4 as the tank 79. The cryogenic fluid is preferably liquid nitrogen but may comprise any non-combustible cryogenic fluid. The valve 75 may be of any suitable type and valves designed to handle cryogenic fluids are known per se.

With further reference to FIG. 4, it is seen that at the top of the frustro-conical walls 65, a port 81 is provided which has mounted thereon an outlet structure generally designated by the reference numeral 82. The outlet structure 82 includes a split sleeve 83 having sleeve halves 85 and 87 as seen in FIG. 4 which combined together to form a structure having a generally cylindrical outer periphery and an inner chamber 89 made up of a plurality of vertically spaced generally cylindrical chambers 91 interconnected by a plurality of generally cylindrical chambers 93, with the chambers 93 being smaller in diameter than the chambers 91.

A module 95 is contained within the chambers, 91, 93 and includes a plurality of disk-like structures 94 separated by intervening rod-like portions 96 such that with the labyrinth module 95 mounted within the outlet device 82 as shown in FIG. 4, a tortuous path restrictor including an annular inlet 97 and an annular outlet 99 is provided.

As seen in FIG. 4, the labyrinth module 95 includes a mounting device 101 consisting of a radially outwardly extending portion which fits within corresponding recesses 103 in the halves 85, 87.

As should be understood from comparison of FIGS. 3 and 4, in assembling the outlet structure 82 together, the halves 85, 87 are separated and the module 95 is inserted therewithin using the projections 101 and recesses 103 with the halves 85, 87 being closed about the module 95 to the orientation shown in FIG. 4. With the halves 85, 87 assembled together to create the common end 88, this end 88 is inserted within theory 81 of the cap 60. As should be understood, from particular review of FIG. 4, fluid exiting the chamber 61 via the annular inlet 97 will travel outwardly and inwardly alternatively several times before arriving at the annular outlet 99. As should be understood by those skilled in the art, the function of this tortuous path of restriction is to retard the velocity of the flow of products of combustion in order to best facilitate extinguishing burning gases.

Now, with the present invention having been described in great detail, the intended mode of operation thereof will be described.

When an oil wellhead such as that which is depicted by the reference numeral 1 in FIG. 1 is uncontrollably on fire, it is desirable to use the inventive device 10 to extinguish, the fire. First, the base 11 is lowered over the oil wellhead 1 using any suitable means such as a crane having a long reach so that the base 11 may be suitably placed without injury to the operator thereof. When so placed, the legs 33 are suitably adjusted by controlling pressure from a supply hydraulic fluid (not shown) and the control valve 53 to cause pivoting motions of the legs 33 to position the feet 41 in a suitable orientation based upon the particular terrain which is confronted. With the claw-like, members 43 embedded in the ground surrounding the oil wellhead 1, the base 11 will be suitably supported in the position shown in FIG. 1.

In this position of the base 11, the cap 60 may then be lowered over the wall structure 22 until arriving at the position shown in FIG. 1 in phantom. In this position, the flow of cryogenic fluid such as, for example, liquid nitrogen may be commenced by opening the valve 75 whereupon the cryogenic fluid will enter the chamber 61 in a rotary path, in the counterclockwise direction in the view of FIG. 3 due to the tangential nature of the ports 71. The presence of liquid nitrogen or other cryogenic fluid will have a double advantage, firstly, cooling the oil wellhead to below a temperature of combustion and, secondly, starving the flaming combustion products of oxygen, the lifeblood of any fire.

After the fire has been extinguished, the flow of liquid nitrogen should continue until such time as the oil wellhead 1, terminus 3 and any surrounding structure including the structure of the base 11 and cap 60 have cooled suitably to a low enough temperature to preclude combustion from resuming. After the fire has been extinguished and the surroundings have been suitably cooled, any suitable means may be employed to stop the flow of oil from the terminus 3. For example, the valve 4 may still be operable and the actuator 5 may be rotated to close the valve. Alternatively, any suitable capping mechanism or blowout preventer may be suitably employed.

As such, an invention has been disclosed in terms of a preferred embodiment thereof which fulfills each and every one of the objects of the invention as set forth hereinabove and provides a new and improved oil wellhead fire extinguishing apparatus of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. An oil wellhead fire extinguishing apparatus comprising:

a) a base including means for surrounding a wellhead and adjustable support means for supporting said base on a ground surface; and b) a cap sized to be mountable over said base, said cap having an internal chamber with at least one inlet port connected to a supply of fluid;

c) said cap having an outlet passageway comprising a tortuous path restrictor structure consisting of a labyrinth module having an annular inlet and an annular outlet.

2. The invention of claim 1, wherein said adjustable support means comprises a plurality of support feet, each foot comprising:

a) a leg pivotally mounted on said base;

b) a fluid motor operatively connected to said leg; and c) valve means for controlling movements of said fluid motor and thereby said leg.

3. The invention of claim 1, wherein said at least one inlet port is mounted tangentially in said chamber.

4. The invention of claim 3, wherein said at least one inlet port comprises plurality of ports.

* * * * *